US011164736B2

(12) United States Patent
Winzek

(10) Patent No.: US 11,164,736 B2
(45) Date of Patent: Nov. 2, 2021

(54) ELECTRODE FOR A DISCHARGE LAMP, DISCHARGE LAMP AND METHOD FOR PRODUCING AN ELECTRODE

(71) Applicant: OSRAM GMBH, Munich (DE)

(72) Inventor: Bernhard Winzek, Berlin (DE)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 17/052,467

(22) PCT Filed: Mar. 27, 2019

(86) PCT No.: PCT/EP2019/057669
§ 371 (c)(1),
(2) Date: Nov. 2, 2020

(87) PCT Pub. No.: WO2019/214875
PCT Pub. Date: Nov. 14, 2019

(65) Prior Publication Data

US 2021/0050207 A1 Feb. 18, 2021

(30) Foreign Application Priority Data

May 7, 2018 (DE) ..... 10 2018 207 038.5

(51) Int. Cl.
*H01J 61/073* (2006.01)

(52) U.S. Cl.
CPC ..... *H01J 61/0732* (2013.01); *H01J 61/0735* (2013.01)

(58) Field of Classification Search
CPC . H01J 61/0732; H01J 61/0735; H01J 61/0737
(Continued)

(56) References Cited

U.S. PATENT DOCUMENTS 6,437,508 B1 8/2002 Sugihara et al.
2009/0226752 A1 9/2009 Barratt et al.
(Continued)

FOREIGN PATENT DOCUMENTS

DE 102009021235 A1 11/2010
DE 102015218878 A1 3/2017
(Continued)

OTHER PUBLICATIONS

International Search Report for International Patent Application No. PCT/EP2019/057669, dated Sep. 20, 2019 (11 pages).

*Primary Examiner* — Christopher M Raabe
(74) *Attorney, Agent, or Firm* — Arent Fox LLP

(57) ABSTRACT

The invention relates to an electrode for a discharge lamp, wherein the electrode has a base body having an electrode plateau providing an end face of the electrode, wherein the base body is delimited by the electrode plateau in a longitudinal extension direction of the electrode. Furthermore, the electrode has a coating, arranged in at least a first region of the base body that is different from the electrode plateau, to increase an emission of heat. In addition, the electrode has an at least partially contiguous free region of the base body extending at least partly in the longitudinal extension direction as far as the electrode plateau, in which the coating for increasing the emission of heat is not arranged, and wherein the first region adjoins at least one section of the free region in the circumferential direction of the electrode.

12 Claims, 2 Drawing Sheets

(58) Field of Classification Search
USPC ..... 313/355
See application file for complete search history.

(56) References Cited

U.S. PATENT DOCUMENTS

| | | | | |
|---|---|---|---|---|
| 2010/0045185 | A1 | 2/2010 | Kitagawa et al. | |
| 2012/0081002 | A1* | 4/2012 | Arimoto | H01J 61/86 313/632 |
| 2012/0181925 | A1* | 7/2012 | Arimoto | H01J 61/86 313/633 |
| 2016/0211130 | A1* | 7/2016 | Minayeva | H01J 61/86 |
| 2017/0092478 | A1* | 3/2017 | Nilius | H01J 61/0737 |

FOREIGN PATENT DOCUMENTS

| | | | |
|---|---|---|---|
| JP | H09180677 | A | 7/1997 |
| JP | 3642153 | B2 | 4/2005 |
| JP | 2008262805 | A | 10/2008 |
| WO | WO2009068099 | A1 | 6/2009 |

* cited by examiner

ELECTRODE FOR A DISCHARGE LAMP, DISCHARGE LAMP AND METHOD FOR PRODUCING AN ELECTRODE

This application is a 35 U.S.C. § 371 National Phase of PCT Application No. PCT/EP2019/057669, filed Mar. 27, 2019, which claims priority to German Application No. 10 2018 207 038.5, filed May 7, 2018, the disclosures of each of which are hereby incorporated by reference herein in their entireties.

The invention relates to an electrode for a discharge lamp, the electrode comprising a base body having an electrode plateau providing an end face of the electrode, the base body being bounded in a longitudinal extent direction of the electrode by the electrode plateau. The electrode furthermore comprises a coating for increasing a thermal emission, arranged in at least one first region of the base body other than the electrode plateau. The invention also includes a discharge lamp having such an electrode and a method for producing an electrode for a discharge lamp.

During the operation of discharge lamps, a plasma discharge arc which radiates electromagnetic radiation is generated between the electrodes. The electrodes usually consist of tungsten, since tungsten is a tough material which melts only at very high temperatures. Particularly in short-arc lamps, in which the electrodes are highly stressed, high electrode temperatures occur. Evaporation of electrode material consequently takes place at the electrode tips, this material being deposited on the inner side of the lamp bulb and therefore leading to clouding of the bulb. This clouding inevitably causes an undesired decrease of the radiant intensity in the course of the service life, and consequently also limits the lifetime of the discharge lamp.

Since the vapor pressure of any substance increases exponentially with increasing temperature, by reducing the electrode tip temperatures it is possible to lower the vapor pressure and consequently the material erosion at the electrode tips efficiently, and therefore ultimately also to lessen the bulb blackening. Such a temperature reduction may be achieved by an emission-increasing coating, in particular the above-described coating for increasing a thermal emission, of the electrode. Such coatings are described, for example, in DE 10 2009 021 235 A1. For example, the lateral surface of such an electrode, or its tungsten base body, may thus be provided with such a coating for increasing the thermal emission.

In short-arc discharge lamps, both without mercury, for example xenon discharge lamps, also known as OSRAM XBO® lamps, which are suitable for example for film projector applications, and those with mercury, for example mercury short-arc lamps, which are also known as OSRAM HBO® lamps and because of their light emission in the UV range are suitable for example for the lithographic structuring of semiconductors, it often occurs during ignition, or immediately after ignition (a few seconds), that the charge carrier density in the plasma is not sufficient to form a stable discharge arc between the tips of the electrodes. In this case, the arc preferentially starts at positions on the electrodes further away from the electrode plateau. In many cases, the arc then starts on the plateau at one of the electrodes and, for the opposite electrode, on the cone or lateral surface of the electrode. It may also occur that the arc starts away from the electrode plateau on both electrodes.

As described, the electrodes in discharge lamps with thermally highly stressed electrodes are provided at least partially with a coating that enhances the thermal radiation. However, this coating does not withstand the arc starting on the coating, which occurs with a certain probability. Partial destruction of the coating then takes place.

Only after a few seconds to about 30 seconds are there sufficient charge carriers in the plasma so that the arc can contract close to the electrode tips within about 1 second. If there is a coated region on the way to the plateau, the plasma arc is often still held back and locally destroys the coating there.

In many types of lamp, furthermore, in the first minutes after ignition of the lamp the discharge arc still lies next to the electrode plateau on the cone of the conical cathode, before it finally moves between the electrodes and then extends from the cathode plateau to the anode plateau. At this stage, the arc then often remains fixed on the cone, and specifically at the edge of the coating, and destroys the edge of the coating there.

Destruction of the coating has the effect that the efficiency of the promotion of the thermal emission is thereby effectively reduced, which in turn shortens the lifetime of the lamp. An even greater disadvantage, however, is above all that the evaporated material of the coating reacts with tungsten, leading to evaporation of tungsten oxide, which creates a deposit on the bulb, and this in turn leads to clouding or blackening of the bulb. In this way, the lifetime of the lamp is reduced even more drastically. In order to prevent destruction of the coating, coatings that are more robust in relation to this scenario could also be used. Such coatings, however, at least those known to date, have the great disadvantage that on the one hand they are more expensive and on the other hand they are much less efficient in relation to their emission-increasing properties. This lower efficiency in relation to the emission-increasing properties in turn has a detrimental effect on the lifetime of the lamp.

The object of the present invention is therefore to provide an electrode for a discharge lamp, a discharge lamp and a method for producing an electrode, by means of which an increase in the lifetime of a discharge lamp is made possible.

This object is achieved by an electrode for a discharge lamp, by a discharge lamp having this electrode and by a method for producing the electrode, having the features according to the respective independent claims. The dependent patent claims, the description and the figures relate to advantageous configurations of the invention.

An electrode according to the invention for a discharge lamp comprises a base body having an electrode plateau providing an end face of the electrode, the base body being bounded in a longitudinal extent direction of the electrode by the electrode plateau. The electrode furthermore comprises a coating for increasing a thermal emission, arranged in at least one first region of the base body other than the electrode plateau. In particular, increasing a thermal emission means increasing the emission coefficient to a value of more than 0.7. Furthermore, the electrode comprises at least one at least regionally, preferably fully, continuous free region of the base body, which extends at least partly in the longitudinal extent direction as far as the electrode plateau and in which the coating for increasing the thermal emission is not arranged, the first region adjoining at least one section of the free region in the circumferential direction of the electrode.

That the free region does not have a coating for increasing the thermal emission does not necessarily mean that the free region must have no coating at all, i.e. it is a region of the base body. Rather, as an alternative, a coating that has a thermal emission coefficient of less than 0.7 may also be provided on the base body in the free region. For example, the coating may comprise tungsten particles, the proportion by volume of the tungsten particles being more than 50%. In particular, the coating may also be applied in the form of a pure tungsten paste. As an alternative, the coating may comprise an additive or a combination of additives from the group of actinides and/or lanthanides (for example La, Ce, Nd) and/or ceramics. Preferably, the additive or the combination of additives have a melting point of more than 2000° C. Furthermore, the additive or the combination of additives preferably have a work function that is less than the work function of tungsten, in particular less than 3.6 eV. In particular, $ZrO_2$, $Y_2O_3$, $ThO_2$, $La_2O_3$ may be envisioned as a ceramic component. The proportion of ceramics used is preferably less than 30 vol. % so that no significant damage in the coating is detectable if the plasma arc starts on the free region.

By virtue of this free region, i.e. a region in which the emission-increasing coating is not arranged, a discharge arc is advantageously provided with a route to the electrode plateau, which it may follow if it starts further away from the electrode plateau in order to reach the electrode plateau without thereby destroying the coating for increasing the thermal emission. The invention is based on the discovery that a discharge arc starting on the electrode, at least if it does not start directly on the electrode plateau, tends to start in the uncoated free region instead of in a region in which the coating for increasing the thermal emission is present, since the charge carrier density in the region of the base body, which is conventionally metallic, in particular made of tungsten, is greater than in the coating region. Such a structure in the coating, i.e. the at least one free region, therefore advantageously makes it possible that the plasma arc of the discharge lamp may start on the electrode at a distance from the electrode plateau without impinging the coating that increases the thermal emission, and furthermore that the plasma arc does not need to cross the coating on the way to the electrode tip, i.e. the electrode plateau, so that damage to the coating that increases the thermal emission is advantageously prevented. If damage to the coating is prevented, clouding or blackening of the bulb due to evaporation of tungsten oxide is also prevented at the same time, which in turn increases the lifetime of the discharge lamp. Above all, it is now furthermore possible to use coatings which, although they are not especially robust in relation to a starting discharge arc, which they now do not need to be because of the invention, do have a particularly high efficiency in relation to increasing the thermal emission, which likewise has a positive effect on the lifetime, as already described in the introduction. By the provision of a continuous free region, in which no coating for increasing the thermal emission is arranged, extending to the electrode plateau on the base body, an increase in the lifetime of a discharge lamp in which an electrode according to the invention is used is therefore made possible in a particularly simple, economical and efficient way.

Furthermore, the electrode may also comprise a plurality of such continuous free regions extending to the electrode plateau. If the electrode comprises a plurality of such free regions, alternative initial positions are advantageously offered to the arc, which in turn minimizes the probability of damage or partial destruction of the coating for increasing the thermal emission. The plurality of free regions may in this case preferably be arranged equidistantly from one another.

The electrode may in this case generally be configured as the anode or as the cathode. Furthermore, the electrode is preferably configured rotationally symmetrically about a rotation axis extending in the longitudinal extent direction. In the case in which the electrode is configured as the cathode, it is preferable for the base body to comprise a cylindrical section and a tapering conical section, which follows on in the longitudinal extent direction toward the electrode plateau and the tip of which is formed by the electrode plateau. If the electrode is configured as the anode, the base body may also comprise only a cylindrical section, of which one end, that is to say the base face of the cylinder, is formed by the electrode plateau. As an alternative, the cylindrical section may also taper somewhat in the direction of the electrode plateau.

Furthermore, the base body is preferably for the most part formed from tungsten, in particular substantially fully from tungsten. In particular, apart from optional doping of the tungsten material, for example with thorium and/or potassium, or apart from optional carbide and/or oxide phases, for example of rare earth metals, contained in the tungsten matrix, the base body may consist fully of tungsten. The doping may, for example, be less than 4 percent by weight. For example, the electron emissivity of the electrode may be increased by doping.

Furthermore, it is advantageous for the first region to adjoin at least one section of the free region in the circumferential direction of the electrode. The first region with the coating for increasing the thermal emission is thus preferably arranged adjacent to the free region in a direction perpendicular to the longitudinal extent direction on the surface of the base body. In other words, the free region does not extend fully around the electrode in the circumferential direction, but extends at least partly through the first region with the coating for increasing the thermal emission in the longitudinal extent direction. This advantageously makes it possible to maximize the area of the first region with the coating for increasing the thermal emission, and therefore the thermal emission per se.

In one advantageous configuration of the invention, the at least one free region is configured in the form of a strip with a width of at least 1 millimeter. By virtue of the fact that the strip-shaped free region is at least 1 millimeter wide, damage to the edge, extending along the free region, of the coating for increasing the thermal emission may advantageously be prevented when the starting discharge arc travels along the free region, since the root of a discharge arc also has a certain width, or a certain diameter, although this does not exceed 1 millimeter. Preferably, the width of the strip-shaped free region is between 1 millimeter and 5 millimeters, particularly preferably between 2 millimeters and 3 millimeters. Especially with a width between 2 and 3 millimeters, it is possible to prevent particularly efficiently a discharge arc traveling along from destroying the edge region of the emission-increasing coating, and at the same time the free region may therefore be kept as small as possible in terms of area, so that larger areas are available for the coating for increasing the thermal emission, which allows a particularly efficient increase in the thermal emission.

The free region furthermore extends from a starting point to the electrode plateau, in particular not necessarily in a straight line, the free region having a length in this running direction which is greater than its width, the width being defined such that it is locally perpendicular to the running direction. The starting point thus constitutes the end of the free region remote from the electrode plateau. Furthermore, the starting point may generally be arranged at any desired position on the base body other than the electrode plateau.

In a further advantageous configuration of the invention, the at least one free region is configured in the form of a strip with a length that is at least as large as half of a maximum diameter of the electrode perpendicular to its longitudinal extent direction. Half of the maximum diameter of the electrode in this case constitutes a characteristic quantity, since when it does not start directly on the electrode plateau but away from it, the discharge arc predominantly starts at a distance from the electrode plateau which is greater than half of the maximum diameter of the electrode. It is therefore particularly advantageous for the at least one free region to have a length which is at least as large as half of the maximum diameter of the electrode, preferably even longer, since in this way a discharge arc not starting on the electrode plateau may with a very high probability start on the free region. The free region may also be significantly longer, however, and may for example extend over the entire base body of the electrode as far as its opposite end from the electrode plateau. This is particularly advantageous since the probability that a discharge arc not starting on the electrode plateau will start on the free region is further increased in this way.

In a further advantageous configuration of the invention, the at least one free region extends in a straight line along the longitudinal extent direction. In other words, the free region extends from the starting point to the electrode plateau in such a way that it extends along the shortest possible connecting line between this starting point and the electrode plateau. Such a rectilinear configuration has the great advantage that it very much simplifies the production of the electrode, as will be discussed in more detail below in connection with the method according to the invention.

Nevertheless, the at least one free region may also extend at least partly in the form of a spiral around the longitudinal extent direction to the electrode plateau. In other words, the free region need not necessarily extend in a straight line to the electrode plateau, and in principle any desired routing possibilities are conceivable. However, if the at least one free region extends at least in part in the form of a spiral around the longitudinal extent direction, it is preferred that it encircles the longitudinal axis of the electrode at most once. In this way, the risk that the discharge arc will nevertheless jump across, or travel through, a coated region on its way to the electrode plateau may be kept small. Furthermore, in the case of a maximally rectilinear route of the free region, the overall area required for the free region is minimized, which in turn provides more area for the coating for increasing the thermal emissions.

It is therefore a further advantageous configuration of the invention when the coating for increasing the thermal emission is arranged on at least half of the overall surface of the base body. In this way, particularly efficient thermal dissipation during operation of the discharge lamp in which the electrode is used may be achieved. The coating for increasing the thermal emission may, however, also be arranged on much more than half of the overall surface of the base body, for example on at least 60 percent, on at least 70 percent, on at least 80 percent or on at least 90 percent. The base body of the electrode may also be coated fully with the coating for increasing the thermal emission, except for the at least one free region and except for the electrode plateau. In this way, the efficiency of the heat dissipation may be maximized.

Preferably, the coating for increasing the thermal emission is configured as a particle composite coating consisting of a matrix layer and particles incorporated into the matrix layer. It is furthermore advantageous for the coating for increasing the thermal emission to comprise a ceramic substance, and in particular is formed to at least 50 percent by volume from the ceramic substance. In this way, a particularly thermally stable coating for increasing the thermal emission may be provided.

It is particularly advantageous in this case for the coating for increasing the thermal emission to comprise a matrix layer of $ZrO_2$ with incorporated tungsten particles, the tungsten particles providing in particular between 2 percent by volume and 40 percent by volume of the coating. Such a coating has been found to be particularly efficient in relation to increasing the thermal emission. In particular, this efficiency is exhibited especially with electrode temperatures in the range of 1000 degrees Celsius or more. Other matrix materials besides $ZrO_2$ may also be envisioned. The melting point of such materials should be as high as possible, preferably more than 2000 degrees Celsius, particularly preferably more than 2500 degrees Celsius. Suitable material classes are inter alia oxides, fluorides, carbides and nitrides, and for example $MgF_2$, SiC or AlN, respectively. However, $ZrO_2$ has been found to be particularly suitable for an oxide matrix layer since it combines a high mechanical stability with high transparency. The matrix imparts stability to the metal structure of the incorporated tungsten particles. This may be further increased by addition of $Y_2O_3$ and/or MgO. As an alternative, the matrix layer may also consist only of $Y_2O_3$ or MgO, instead of $ZrO_2$.

The thickness of the matrix layer, and therefore also of the coating for increasing the thermal emission itself, may for example lie in the range of between 1 micrometer and 1 millimeter, particularly preferably between 10 micrometers and 300 micrometers. The proportion by volume of the metal particles, i.e. of the tungsten particles, is particularly preferably between 5 and 30 percent, in particular between 5 and 15 percent.

In a further particularly advantageous configuration of the invention, the electrode comprises a tungsten coating, which is arranged in at least one second region of the base body adjacent to an edge of the coating for increasing the thermal emission facing toward the electrode plateau.

The tungsten coating may, for example, consist of tungsten powder sintered on. Arranging the tungsten coating between the coating for increasing the thermal emission and the electrode plateau has the advantage that an arc starting at the edge of the electrode plateau does not damage the coating for increasing the thermal emission lying in the vicinity. This tungsten coating ensures that the arc preferentially starts there and leaves the thermally less stable coating for improved thermal radiation undamaged. In addition, the tungsten coating also leads to an increase in the thermal emission, even though the thermal emission coefficient thereby achievable remains less than 0.7.

For example, the at least one second region, that is to say the region in which this tungsten coating is arranged, may constitute a region which is annular in the circumferential direction of the electrode, that is to say it extends around the electrode axis, and is in particular continuous or interrupted, i.e. discontinuous in the circumferential direction. This annular region may thus follow on directly from the edge of the coating for increasing the thermal emission in the direction of the electrode plateau. Destruction of the edge of the coating may thereby be effectively prevented.

This protection, however, is also provided when the tungsten coating is applied partially and is therefore not arranged continuously at the edge of the coating in the circumferential direction of the electrode. In other words, the base body may comprise a plurality of second regions, which are respectively arranged adjacent to the edge of the coating for increasing the thermal emission and at a distance from one another in the circumferential direction of the electrode, the tungsten coating being arranged in a respective one of the second regions. Since the tungsten coating is metallic but the coating for increasing the thermal emission for the most part comprises a nonmetallic matrix material, the discharge arc prefers the second regions with the metallic tungsten coating as an initial position and therefore automatically avoids the coating for increasing the thermal emission. Applying the tungsten coating in only a single continuous second region is, however, particularly advantageous since it is particularly economical because of the simpler production.

It is furthermore advantageous for the at least one second region to have a width which extends in the direction of the electrode plateau from the edge of the coating for increasing the thermal emission and is at least 0.5 millimeters. By virtue of this minimum width, particularly effective protection of the edge of the coating for increasing the thermal emission may be ensured.

Whether or not the at least one second region partly overlaps with the free region, that is to say whether the additional tungsten coating sintered onto the base body is or is not also arranged partly in the free region, is in this case unimportant for the migration of the discharge arc from the initial position to the electrode plateau.

Therefore, it is thus conceivable that, according to a further configuration of the invention, a part of the at least one second region overlaps with an end of the free region facing toward the electrode plateau, so that the tungsten coating is arranged at least partially in at least a part of the end of the free region. The free region may thus, for example, extend in the direction of the electrode plateau and lead into the tungsten coating for protecting the edge of the coating for increasing the thermal emission. A discharge arc migrating on the free region in the direction of the electrode plateau is therefore guided automatically onto the tungsten coating for protecting the edge of the coating for increasing the thermal emission and travels from the latter directly to the electrode plateau, so that the discharge arc during its contraction is advantageously not held back on the way to the electrode plateau by any layer that is unstable in relation to the plasma arc, so that the coating for increasing the thermal emission also remains entirely undamaged.

As an alternative, the tungsten coating and the free region may also be arranged in such a way that the at least one second region, in which the tungsten coating is arranged, and the free region do not overlap, so that no additional tungsten coating is arranged in the free region of the base body. In this way as well, the discharge arc starting at a position remote from the electrode plateau may travel simply and unimpeded to the electrode plateau without destroying the coating for increasing the thermal emission. Furthermore, this variant also allows particularly simple production of the electrode.

The invention also relates to a discharge lamp having an electrode according to the invention or one of its configurations. In particular, the discharge lamp may also comprise two of the electrodes according to the invention or two of their configurations, in which case one of the electrodes is preferably configured as the anode and one as the cathode.

The electrodes may in this case be arranged in a lamp bulb of the discharge lamp, this lamp bulb being filled with a gas mixture. The discharge lamp may furthermore be configured like the lamps described in the introduction. For example, the discharge lamp may be configured as an XBO lamp, for example as a xenon short-arc lamp. XBO lamps emit light in the visible wavelength range and are used, for example, in conventional and digital film projection. The discharge lamp may also be configured as an HBO lamp, in particular as a mercury short-arc lamp, in which the bulb is filled with a gas mixture comprising mercury. Such lamps emit light at least partly in the UV range and may, for example, be used for the lithographic structuring of semiconductors.

The advantages described for the electrode according to the invention and its embodiments apply similarly for the discharge lamp according to the invention and its embodiments.

Furthermore, the invention relates to a method for producing an electrode for a discharge lamp, wherein a base body having an electrode plateau providing an end face of the electrode is provided, the base body being bounded in a longitudinal extent direction of the electrode by the electrode plateau. Furthermore, the base body is coated in at least one first region of the base body other than the electrode plateau with a coating for increasing a thermal emission, in such a way that at least one free region which extends at least partly in the longitudinal extent direction as far as the electrode plateau, and in which the coating for increasing the thermal emission is not arranged, is provided, and the first region adjoins at least one section of the free region in the circumferential direction of the electrode.

In this way, the free region, in which the coating for increasing the thermal emission is not arranged, may be produced in a particularly simple and economical way. Here again, the advantages mentioned for the electrode according to the invention and its configurations apply similarly for the method according to the invention for producing the electrode. In addition, the physical features mentioned in connection with the electrode according to the invention and its embodiments allow refinement of the production method according to the invention by further corresponding method steps.

An embodiment of the electrode in which the free region extends in the form of a strip and in a straight line in the longitudinal extent direction to the electrode plateau has been found to be particularly advantageous in this case. In this way, the coating method may be made particularly simple. Nevertheless, a free region which extends at least in part not in a straight line, for example in the form of a spiral, may be provided by this production method.

Furthermore, the coating with the coating for increasing the thermal emission may be carried out by sintering on the base body. The tungsten coating described above, which is arranged in at least one second region adjacent to the edge of the coating for increasing the thermal emission, may also be provided in a corresponding production step by sintering tungsten powder on in the corresponding second regions.

Electrodes which allow a significant increase in the lifetime of discharge lamps may therefore be provided in a particularly simple, economical and time-efficient manner.

Further advantages, features and details of the invention may be found from the following description of preferred exemplary embodiments and with the aid of the drawing.

Figure 1:
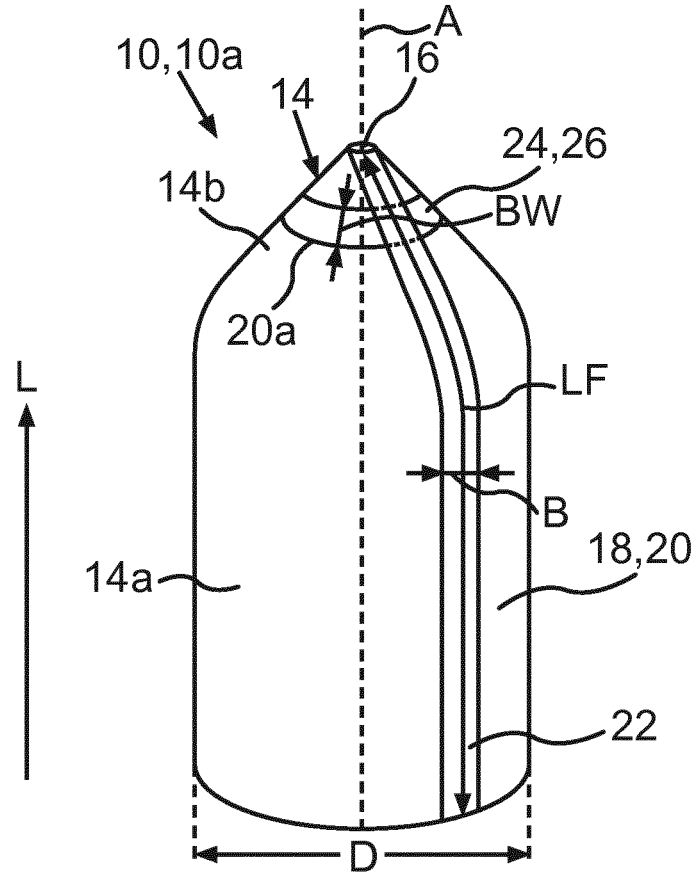
FIG. 1 shows a schematic representation of an electrode for a discharge lamp having an uncoated free region extending in a straight line to the electrode plateau, according to one exemplary embodiment of the invention.

FIG. 1 shows a schematic representation of an electrode 10 for a discharge lamp 12 (cf. FIG. 4) according to one exemplary embodiment of the invention. The electrode 10 is configured as the cathode 10*a* in this exemplary embodiment. It may, however, also be configured in a similar way as the anode 10*b* (cf. FIG. 4). In this example, the electrode 10 thus comprises a base body 14. The latter in turn comprises an electrode plateau 16 providing an end face of the electrode 10. In this case, the base body 14 is bounded in a longitudinal extent direction L, which extends parallel to the electrode axis A, by the electrode plateau 16.

Figure 4:
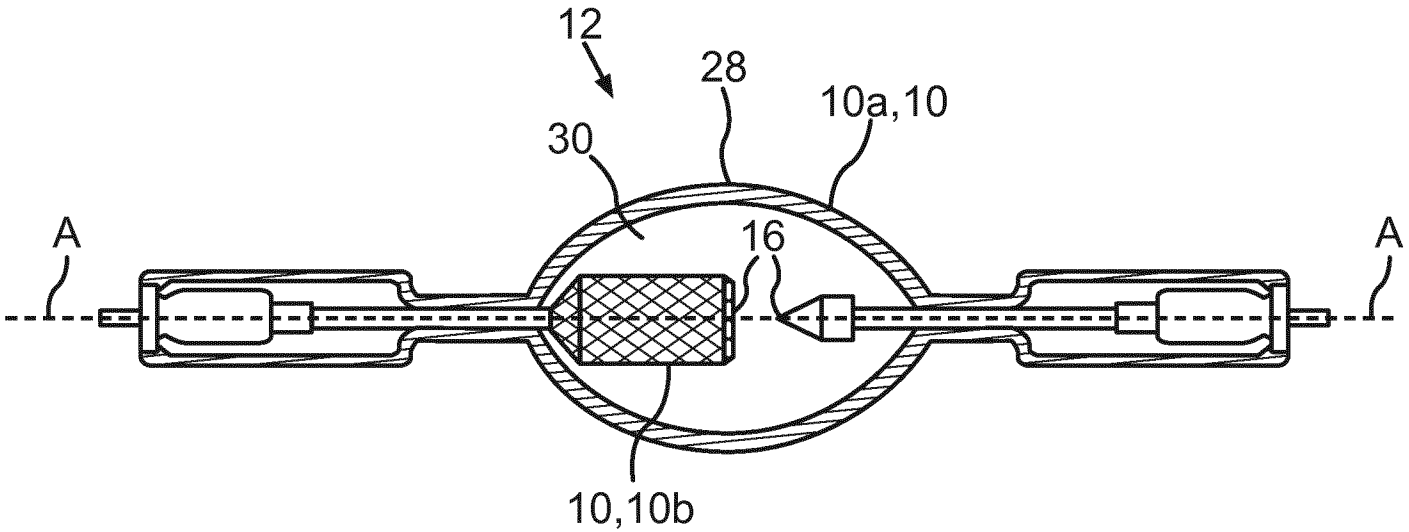
FIG. 4 shows a schematic representation of a discharge lamp according to one exemplary embodiment of the invention.

In this example, the base body 14 is composed of a cylindrical section 14*a* and a cone-shaped, or conical, section 14*b*. The electrode 10 may, however, also be shaped in any other desired way, for example if it is configured as the anode 10*b*, as represented in FIG. 4. In this example, essentially the conical section 14*b* is omitted and the electrode plateau 16 follows on substantially directly from the cylindrical section 14*a*.

In order to improve the thermal radiation power, the surface is coated in a first region 18 of the base body 14 other than the electrode plateau 16 with a coating 20 for increasing the thermal emission. This coating 20 preferably constitutes a particle composite coating consisting of a $ZrO_2$ matrix layer with incorporated tungsten particles. To this end, for example, a powder mixture consisting of 10 percent by volume tungsten and 90 percent by volume $ZrO_2$ may be sintered on.

During operation of a discharge lamp, for example the discharge lamp 12 as represented in FIG. 4, a corresponding discharge arc is finally formed between the respective electrode plateaus 16 of the cathode 10*a* and of the anode 10*b*.

When igniting short-arc discharge lamps, it often occurs that the charge carrier density in the plasma is not sufficient to form a stable discharge arc between the tips of the electrodes 10 from the start. In this case, the arc initially starts at positions on the electrode 10 which are further away from the electrode plateaus 16. In conventional electrodes, it then very often occurs that this arc starts on the emission-increasing coating, which generally destroys such coatings partially, and furthermore leads to increased clouding or blackening of the bulb and overall to a reduction of the lifetime of the discharge lamp.

In order to prevent this, a free region 22, in which the coating 20 for increasing the thermal emission is not arranged, is now advantageously provided on the base body 14. This free region 22 is configured in the form of a strip and extends at least partly in the direction of the longitudinal extent direction L as a continuous area as far as the electrode plateau 16. In general, this free region 22 has a length LF and a width B locally perpendicular thereto, as represented in FIG. 1. The length LF is in this case greater than the width B. The length LF of the free region 22 is preferably at least as large as half of the diameter D of the electrode 10, particularly in relation to the widest region of the electrode 10, or in relation to the cylindrical section 14*a*.

In this example represented here in FIG. 1, the free region 22 extends in the form of a strip in a straight line over the entire length of the electrode 10 as far as the electrode plateau 16. The free region 22 may, however, also be configured to be shorter. It is furthermore preferred for the width B of the free region 22 to be at least 1 millimeter, preferably at least 2 millimeters, in particular between 2 millimeters and 5 millimeters.

The discharge arcs are therefore advantageously provided with the possibility of starting in the free region 22, and therefore directly on the thermally stable surface of the base body 14 of the electrode 10, which is essentially formed from tungsten. This strip 22 extending toward the electrode plateau advantageously makes it possible that the discharge arc is not hindered by any coating 20 during its contraction between the electrode tips, and is therefore not held back on the way to the electrode plateau 16. In order to offer the arc alternative initial positions, a plurality of such strips, in particular such free regions 22, may also be provided.

The discharge arc may advantageously therefore sweep along on the way from the initial arc position to the electrode plateau 16 without destroying the heat-radiating coating 20. By virtue of the free region 22 being small in terms of area, the efficiency of the thermal emission, which is promoted by the coating 20, is not impaired, or is impaired only slightly.

So that the arc also does not destroy the edge 20*a* of the cathode coating, that is to say the coating 20 for increasing the thermal emission, close to the plateau 16 in the second start-up phase, in the first minutes after the ignition, the coating edge 20*a* is also provided with a coating of tungsten powder sintered on, i.e. a tungsten coating 24, particularly in the region close to the cathode plateau, or generally of the electrode plateau 16. This coating ensures that the arc preferably starts there and the thermally less stable coating 20 for improved thermal radiation remains undamaged.

This tungsten coating 24 preferably has a minimum width BW of at least 0.5 millimeters, which extends from the edge 20*a* of the coating 20 in the direction of the electrode plateau 16. Furthermore, in the example represented in FIG. 1, the free region 22 extends in a straight line as described, and the tungsten coating 24 is arranged extending annularly around the axis A in a second region 26 of the base body 14, the free region 22 also extending through the tungsten coating 24 and therefore interrupting its annular structure. Both the free region 22 and the tungsten coating 24 may respectively also assume different shapes, without thereby losing their function. This will now be explained in more detail with the aid of FIG. 2 and FIG. 3.

Figure 2:
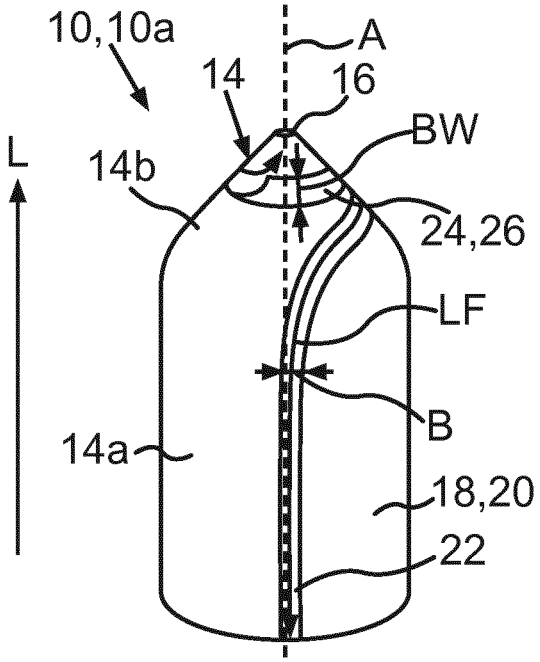
FIG. 2 shows a schematic representation of an electrode having a free region extending in the form of a spiral to the electrode plateau, according to a further exemplary embodiment of the invention.

FIG. 2 shows a schematic representation of an electrode 10 according to a further exemplary embodiment of the invention. In particular, the electrode 10 may be configured as described with reference to FIG. 1 except for the differences described below. In this example, the free region 22 is configured at least partly in the form of a spiral in the direction of the longitudinal extent direction L of the electrode 10, particularly in the region of the conical section 14*b* of the base body 14. In the case of such a spiral configuration of the free region 22, however, it is preferred for the free region 22 to fully encircle the electrode axis A at most once, in order to offer the discharge arc a path that is as simple as possible to the electrode plateau 16. The helical structure of the free region 22 in the vicinity of the electrode plateau 16 in turn leads directly into the tungsten coating 24 for protecting the edge 20*a* of the coating 20, the tungsten coating 24 here as well in turn being arranged in a second continuous region 26 which extends in an open ring shape around the electrode axis A.

Figure 3:
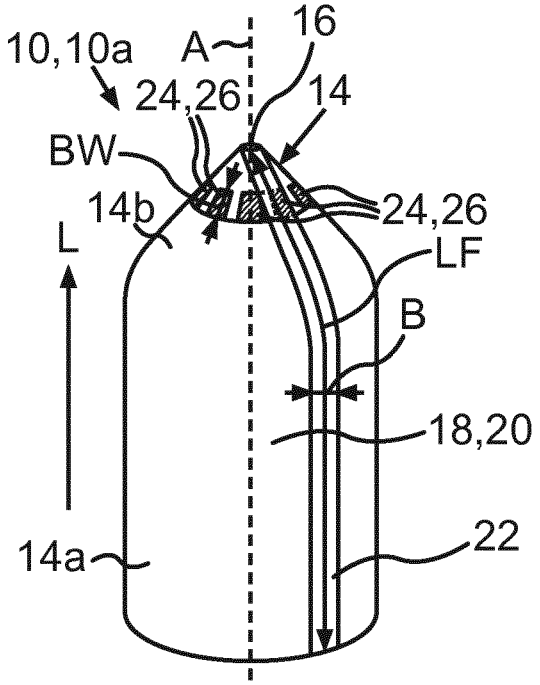
FIG. 3 shows a schematic representation of an electrode having a partially applied tungsten coating at the edge of the coating for increasing the thermal emission.

The function of this tungsten coating 24 is, however, also provided if this tungsten coating 24 is partially applied, as is represented in FIG. 3. FIG. 3 in turn shows an electrode 10 according to a further exemplary embodiment of the invention, which in particular may in turn be configured as described with reference to FIG. 1 except for the differences described below. These differences are in this case restricted in particular only to the configuration, or arrangement, of the tungsten coating 24. The latter is now in this example arranged in a plurality of mutually separated second regions 26, which are arranged extending around the axis A of the electrode 10 and adjacent to the edge 20*a* of the coating 20 for increasing the thermal emission.

FIG. 4 shows a schematic representation of a discharge lamp 12, which in this example is configured as a high-pressure discharge lamp in short-arc technology. The discharge lamp 12 furthermore comprises two electrodes 10 according to exemplary embodiments of the invention, one of which is configured as the anode 10*b* and one as the cathode 10*a*. In this case, the cathode 10*a* and/or the anode 10*b* may be configured as described with reference to FIG. 1 to FIG. 3. The anode 10*b* additionally differs from the cathode 10*a* by its shaping, as may be seen from FIG. 4. In particular, the anode 10*b* has a much larger diameter D, preferably in the range of between 2 and 4 centimeters, while the cathode 10*a* has a much smaller diameter D, preferably in the range of less than or up to at most 3.0 centimeters, particularly preferably up to at most 2.5 centimeters.

The discharge lamp 12 furthermore comprises the components which are conventional for such a lamp, such as a discharge tube 28, a discharge space 30, which is filled with a gas mixture and in which the electrodes 10 are located, and further components. The respective electrode plateaus 16 of the anode 10*b* and of the cathode 10*a* in this case face toward one another and the electrode axes A lie approximately along a line, that is to say the cathode 10*a* and the anode 10*b* are arranged coaxially with one another. Both electrodes 10 may comprise a free region 22 as described above. These respective free regions 22 are preferably arranged on the same side in relation to the axis A, i.e. for example they both extend at the top on the anode 10*b* and at the top on the cathode 10*a*, or underneath in relation to the two electrodes 10, or on any desired side, but always on the same one in relation to the respective axis A and/or longitudinal extent direction L of the anode 10*b* and of the cathode 10*a*. Even though the discharge arc often starts during ignition on the electrode plateau 16 at one of the two electrodes 10 and on the cone or lateral surface of the electrode 10 only at the other of the two electrodes, often the cathode, in infrequent cases it may nevertheless occur that the arc starts away from the plateau 16 at both electrodes 10. In this case, the unilateral arrangement of the free region 22 facilitates the contraction of the arc, and the probability that it will touch the coating 20 or cross it is additionally reduced.

Overall, an electrode, a discharge lamp and a production method are thus provided, which advantageously make it possible to increase the lifetime of the discharge lamp further by particularly economical measures, namely by a free region extending toward the electrode plateau.

LIST OF REFERENCES

10 electrode
10*a* cathode
10*b* anode
12 discharge lamp
14 base body
14*a* cylindrical section
14*b* conical section
16 electrode plateau
18 first region
20 coating for increasing the thermal emission
20*a* edge of the coating for increasing the thermal emission free region
24 tungsten coating
26 second region
28 discharge tube
30 discharge space
A electrode axis
B width of the free region
D diameter of the electrode
BW width of the tungsten coating
L longitudinal extent direction of the electrode
LF length of the free region

The invention claimed is:

1. An electrode for a discharge lamp, the electrode comprising:

a base body having an electrode plateau providing an end face of the electrode, the base body being bounded by the electrode plateau in a longitudinal extent direction of the electrode; and a coating for increasing a thermal emission, arranged in at least one first region of the base body other than the electrode plateau, characterized in that the electrode comprises at least one at least regionally continuous free region of the base body, which extends at least partly in the longitudinal extent direction as far as the electrode plateau and in which the coating for increasing the thermal emission is not arranged, the first region adjoining at least one section of the free region in a circumferential direction of the electrode.

2. The electrode as claimed in claim 1, characterized in that the at least one free region is configured in a form of a strip with a width of at least 1 mm.

3. The electrode as claimed in claim 1, characterized in that the at least one free region is configured in a form of a strip with a length that is at least as large as half of a maximum diameter of the electrode perpendicular to its longitudinal extent direction.

4. The electrode as claimed in claim 1, characterized in that the at least one free region extends in a straight line along the longitudinal extent direction.

5. The electrode as claimed in claim 1, characterized in that the at least one free region extends at least partly in a form of a spiral around the longitudinal extent direction.

6. The electrode as claimed in claim 1, characterized in that the coating for increasing the thermal emission is arranged on at least half of an overall surface of the base body.

7. The electrode as claimed in claim 1, characterized in that the coating for increasing the thermal emission comprises a ceramic substance, and in particular is formed to at least 50 percent by volume from the ceramic substance.

8. The electrode as claimed in claim 1, characterized in that the coating for increasing the thermal emission comprises a matrix layer of $ZrO_2$ with incorporated tungsten particles, the tungsten particles providing in particular between 2 percent by volume and 40 percent by volume of the coating.

9. The electrode as claimed in claim 1,
characterized in that
the electrode comprises a tungsten coating, which is arranged in at least one second region of the base body adjacent to an edge of the coating for increasing the thermal emission facing toward the electrode plateau.

10. The electrode as claimed in claim 9,
characterized in that
the at least one second region constitutes a region which is annular in the circumferential direction of the electrode, and is in particular continuous or discontinuous in the circumferential direction.

11. The electrode as claimed in claim 9,
characterized in that
the base body comprises a plurality of second regions, which are respectively arranged adjacent to the edge of the coating for increasing the thermal emission and at a distance from one another in the circumferential direction of the electrode, the tungsten coating being arranged in a respective one of the plurality of second regions.

12. The electrode as claimed in claim 9, characterized in that the at least one second region has a width which extends in a direction.

* * * * *